US007607378B2

(12) United States Patent
Wuensch

(10) Patent No.: US 7,607,378 B2
(45) Date of Patent: Oct. 27, 2009

(54) ROLLED GOODS DISPENSER

(75) Inventor: Steffen Wuensch, Holzgerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 486 days.

(21) Appl. No.: 10/557,934

(22) PCT Filed: May 24, 2005

(86) PCT No.: PCT/EP2005/052362

§ 371 (c)(1),
(2), (4) Date: Feb. 2, 2006

(87) PCT Pub. No.: WO2006/010655

PCT Pub. Date: Feb. 2, 2006

(65) Prior Publication Data

US 2007/0125216 A1 Jun. 7, 2007

(30) Foreign Application Priority Data

Jun. 24, 2004 (DE) ..... 10 2004 030 451

(51) Int. Cl.
*B26D 1/03* (2006.01)

(52) U.S. Cl. ..... 83/649; 83/682; 83/687

(58) Field of Classification Search ..... 83/649, 83/650, 687, 691, 681, 682
See application file for complete search history.

(56) References Cited

U.S. PATENT DOCUMENTS

| | | | | | |
|---|---|---|---|---|---|
| 1,267,599 | A | * | 5/1918 | Shanklin | 83/392 |
| 2,392,488 | A | * | 1/1946 | MacCallum, Jr. | 83/649 |
| 3,558,254 | A | * | 1/1971 | Cahill | 83/176 |
| 4,028,170 | A | * | 6/1977 | Savarimuthu | 156/513 |
| 4,880,248 | A | | 11/1989 | Elmer | |
| 5,099,671 | A | * | 3/1992 | Beaulac | 72/331 |

FOREIGN PATENT DOCUMENTS

| | | |
|---|---|---|
| DE | 31 16 527 A1 | 11/1982 |
| DE | 34 43 168 | 8/1986 |
| DE | 93 06 844 | 7/1993 |
| GB | 2 277 729 | 11/1994 |

* cited by examiner

*Primary Examiner*—Kenneth E. Peterson
(74) *Attorney, Agent, or Firm*—Michael J. Striker

(57) ABSTRACT

In a rolled product dispenser, when the rolled product is unrolled, a simple, quick punching of required holes in the rolled product and a simultaneous cutting to length are achieved by virtue of the fact that the rolled product dispenser has a hole punching and cutting device.

3 Claims, 6 Drawing Sheets

B - B

ROLLED GOODS DISPENSER

CROSS-REFERENCE TO RELATED APPLICATION

The invention described and claimed hereinbelow is also described in German Patent Application DE 10 2004 030 451.3 filed on Jun. 24, 2004. This German Patent Application, whose subject matter is incorporated here by reference, provides the basis for a claim of priority of invention under 35 U.S.C. 119(a)-(d).

BACKGROUND OF THE INVENTION

The present invention relates a rolled product dispenser.

Rolled product dispensers are known and include, for example, tape dispensers for use in offices. The product dispensed by the dispenser is wound into the form of a roll. In particular, standard abrasive materials such as sandpaper are also sold in this rolled form. The user tears or cuts this rolled product to the desired length.

In certain rolled products, the segments that are torn or cut to length must be provided with holes before being used. For example, abrasive materials that are used in sanders equipped with suction dust removal must be perforated before use in order to provide the holes required for the suction dust removal. According to the prior art, the user must therefore first take the desired length of rolled product from the dispenser and then produce the required holes in the removed rolled product. Before the rolled product can be used, the user must first execute numerous time-consuming manual operations. As a result, achieving a more convenient, simple, and timesaving preparation of the rolled product would be a desirable thing.

SUMMARY OF THE INVENTION

Accordingly, it is an object of the present invention to provide a rolled product dispenser which has the advantage of the prior art that the rolled product dispenser has a hole punching device that permits the user to easily and quickly punch the required holes in the rolled product as it is being dispensed.

The term "hole punching device" is understood to be any device with which one or more holes can be punched into a segment of the rolled product.

The hole punching device according to the invention allows the user to perform the perforation of the needed segment of rolled product as part of the dispensing process, directly in the dispenser itself. After dispensing the rolled product, the user does not have to execute any further manual operations in order to perforate the dispensed segment, but can instead use the segment immediately.

It is advantageous if the hole punching device according to the invention has at least one punching pin and a pressure plate.

The punching pin is preferably annular in shape. In particular, the punching pin can be embodied as a round metal blade insert or as a sharp-edged plastic cutter, the latter alternative having the advantage of being less expensive. According to the invention, it is also possible for there to be a number of punching pins, depending on the number of holes to be punched.

The pressure plate is preferably flat and rectangular and preferably has one or more bores to accommodate the one or more punching pins. The punching operation can be executed by pressing the pressure plate down onto the punching pins.

Preferably, the hole punching device also has a receiving plate. The receiving plate receives the segment of rolled product to be perforated and performs the function of limiting this segment in the longitudinal direction and guiding it in the transverse direction. The receiving plate can have pieces attached along its sides to guide the segment.

In addition, the receiving plate can have a longitudinal stop in the middle. This longitudinal stop is preferably comprised of one or more raised protrusions. In a particularly preferred embodiment, the one or more raised protrusions are embodied in the form of knobs or lugs. The longitudinal stop in the middle makes it possible for the hole punching device to punch holes not only into segments of rolled product that are the full length of the receiving plate but also into segments that are half the length of the receiving plate.

If the hole punching device also has at least one compression spring, the pressure plate and the receiving plate can be automatically returned into their initial positions after punching.

Preferably, the rolled product dispenser has a cutting blade. The function of the cutting blade is to cut the required segment of rolled product to the correct length. In particular, the cutting blade can be situated so that the segment is cut from the roll at the same time as holes are punched into it. This permits the user of the rolled product dispenser according to the invention not only to punch the required holes easily and quickly, but also to cut the rolled product to precisely the required to length at the same time.

In a particular embodiment of the invention, the rolled product dispenser has a roll holder. The roll holder holds the product roll in position. The roll holder prevents the roll from falling out of the dispenser.

If the rolled product dispenser is also incorporated into a box, in particular a toolbox for a sander, then the user does not have to bring the rolled product dispenser separately but instead has all of the elements conveniently on hand in the one box. Preferably, the pressure plate is situated on the box lid. This allows the holes to be punched simply by closing the box lid. Instead of being situated in a box, the rolled product dispenser can also be embodied in the form of an integrated rolled product dispenser to be erected or wall-mounted, or can also be embodied in some other way.

Finally, the rolled product dispenser according to the invention is preferably embodied in the form of a sandpaper dispenser, in particular a sandpaper dispenser for standard sandpaper sold as a rolled product.

BRIEF DESCRIPTION OF THE DRAWINGS

In the description below, exemplary embodiments of the invention will be explained in greater detail in conjunction with the accompanying drawings.

DESCRIPTION OF THE PREFERRED EMBODIMENTS

Figure 1:
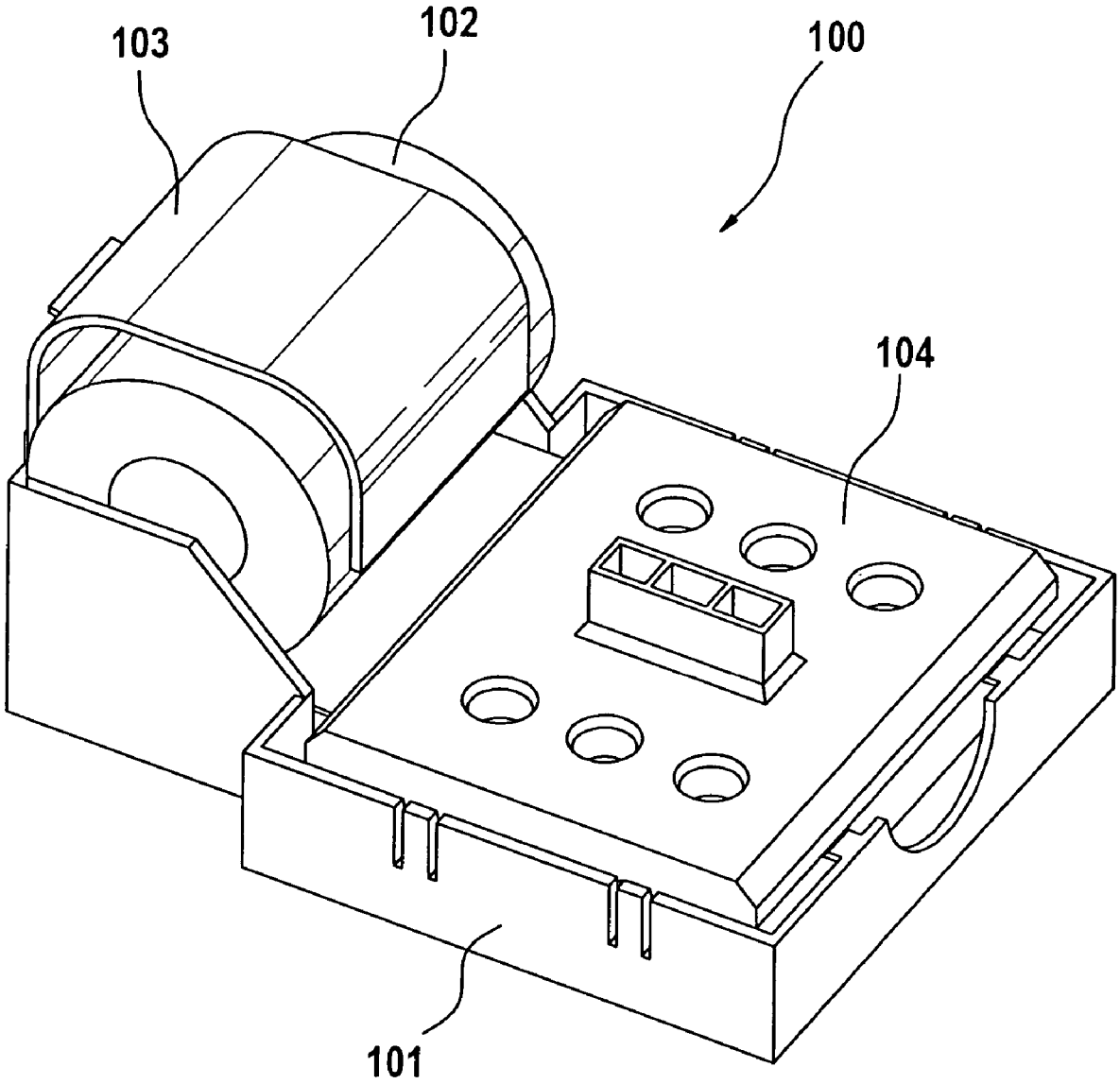
FIG. 1 is a perspective overall view of one embodiment form of the rolled product dispenser according to the invention.

FIG. 1 is an overall view of a sandpaper dispenser 100 that is ready for use. The sandpaper dispenser 100 has a housing 101. The housing 101 contains a sandpaper roll 102 that is held by a roll holder 103. A pressure plate 104 is also supported in the housing 101.

The sandpaper dispenser 100 can be embodied in separate configurations for the individual sizes of sandpaper sheets ½ (280×115 $mm^2$), ⅓ (230×93 $mm^2$), and ¼ (140×115 $mm^2$). However, a ¼ sheet version can be produced from the ½ sheet version by setting a longitudinal stop so that it is also possible for the ½ sheet version and the ¼ sheet version to be combined.

Figure 2:
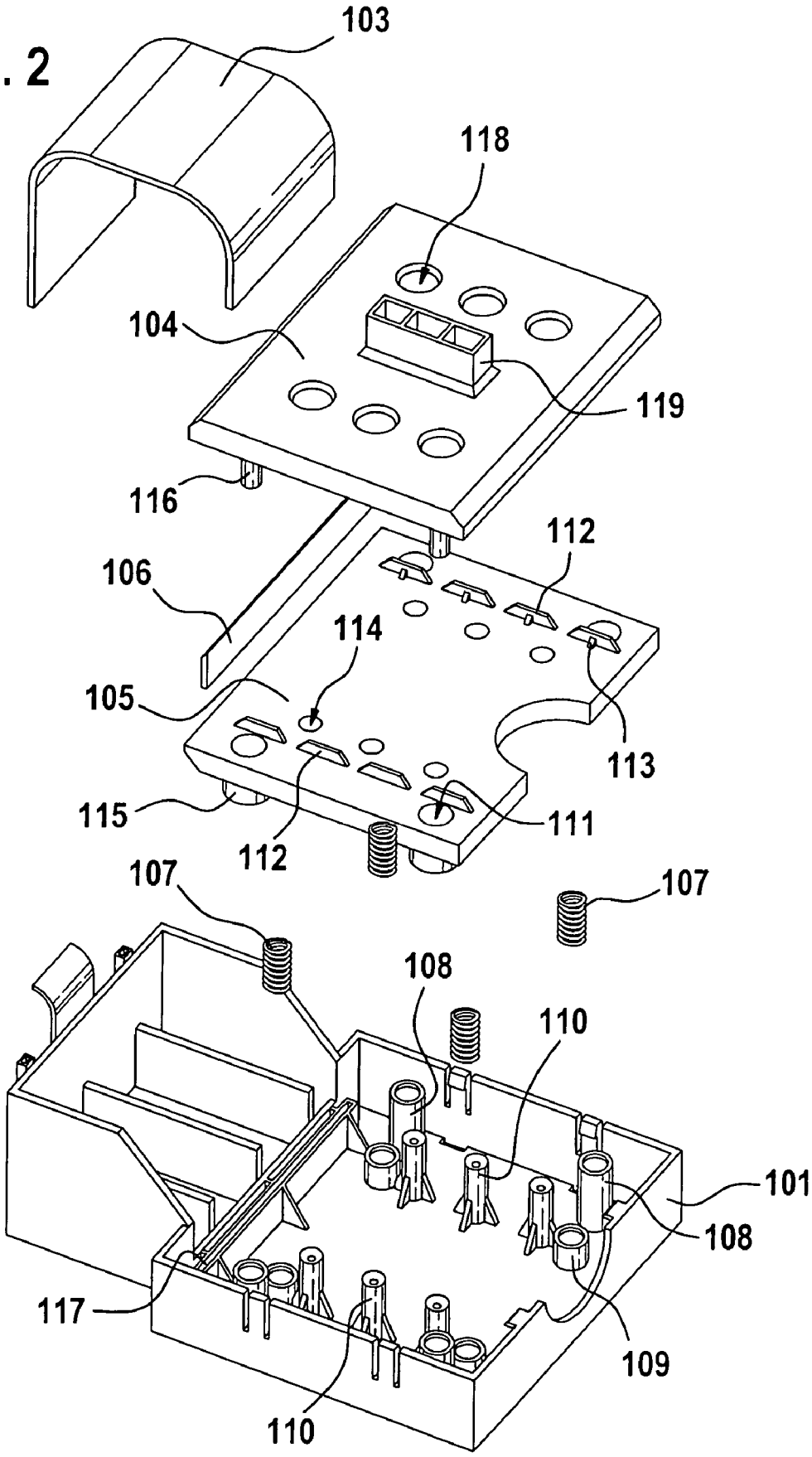
FIG. 2 is an exploded view of the rolled product dispenser according to FIG. 1.

FIG. 2 shows the individual components of the sandpaper dispenser 100 in an exploded view. In addition to the housing 101, the roll holder 103, and the pressure plate 104, the sandpaper dispenser 100 also includes a sandpaper receiving plate 105, a cutting blade 106, and four compression springs 107.

The housing 101 functions as the actual dispenser or as a storage receptacle for the sandpaper. The dimensions of the housing 101 are matched to the corresponding width of sandpaper. The housing 101 contains guides 108 for the sandpaper receiving plate 105 and the pressure plate 104 as well as recesses 109 for the compression springs 107. In addition, annular punching pins 110 for producing suction holes in the sandpaper are attached in the housing 101.

The sandpaper receiving plate 105 has four first bores 111 that feed into four outer domes 115. The sandpaper receiving plate 105 is guided into the four first bores 111, the four domes 115 underneath the sandpaper receiving plate 105 serving as the guide posts. The four first bores 111 also serve to guide the pressure plate 104.

The sandpaper receiving plate 105 has pieces 112 attached to it on both sides, which guide the sandpaper in the lateral direction. The side surfaces of the pieces 112 have small triangular raised protrusions 113, which compensate for variations in the sandpaper and exert a slight clamping action to hold the sandpaper at the ends of the sandpaper receiving plate 105.

Second bores 114 in the sandpaper receiving plate 105 within a sandpaper width serve as through openings for the punching pins or punching dies 110.

The pressure plate 104 constitutes the upper extremity of the sandpaper dispenser 100. It rests on the sandpaper and is guided with four pins 116 in the sandpaper receiving plate 105 lying underneath it. The pressure plate 104 has six bores 118 and a handle 119.

The cutting blade 106 made of hardened steel is situated in a recess 117 at a suitable location in the housing 101. The cutting edge of the cutting blade 106 is covered by the sandpaper receiving plate 105 so that there is no danger of injury when guiding the sandpaper or due to inadvertent contact with the blade. The cutting blade 106 is only uncovered when the pressure plate 104 is pressed down.

The four compression springs 107 are situated between the housing 101 and the sandpaper receiving plate 105 and serve to return the sandpaper receiving plate 105 and the pressure plate 104 back to their starting positions after the sandpaper has been punched and cut.

The roll holder 103 presses against the sandpaper roll 102 with a slight amount of initial stress, holding it in position and preventing it from falling out.

Figure 3:
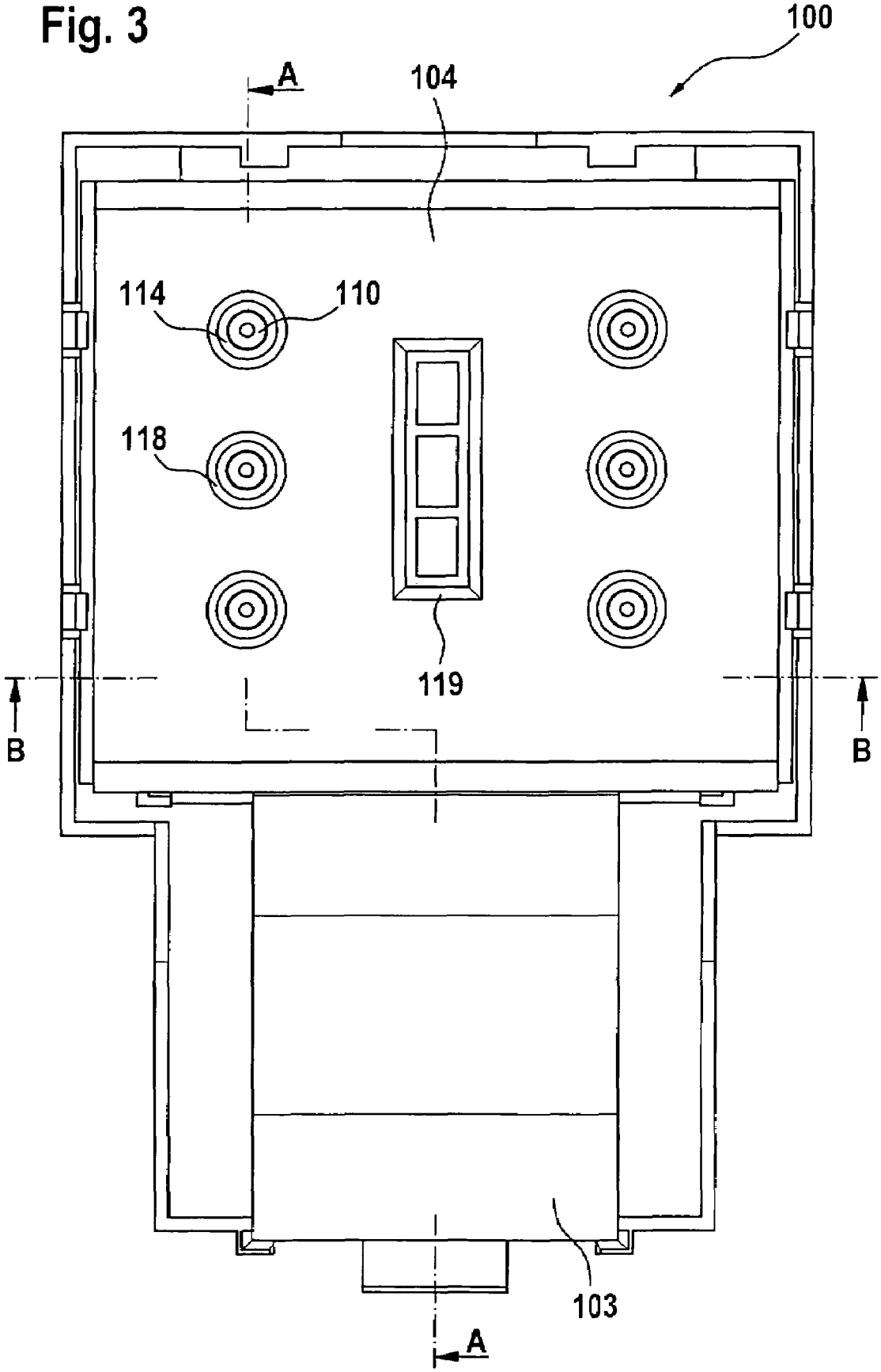
FIG. 3 is a top view of the rolled product dispenser according to FIG. 1.

FIG. 3 is a top view of the sandpaper dispenser 100, showing the pressure plate 104 with its handle 119. The punching pins 110 are visible in the middle of the bores 118 in the pressure plate 104. The punching pins 110 also pass through the likewise visible second bores 114 of the sandpaper receiving plate 105.

Figure 4:
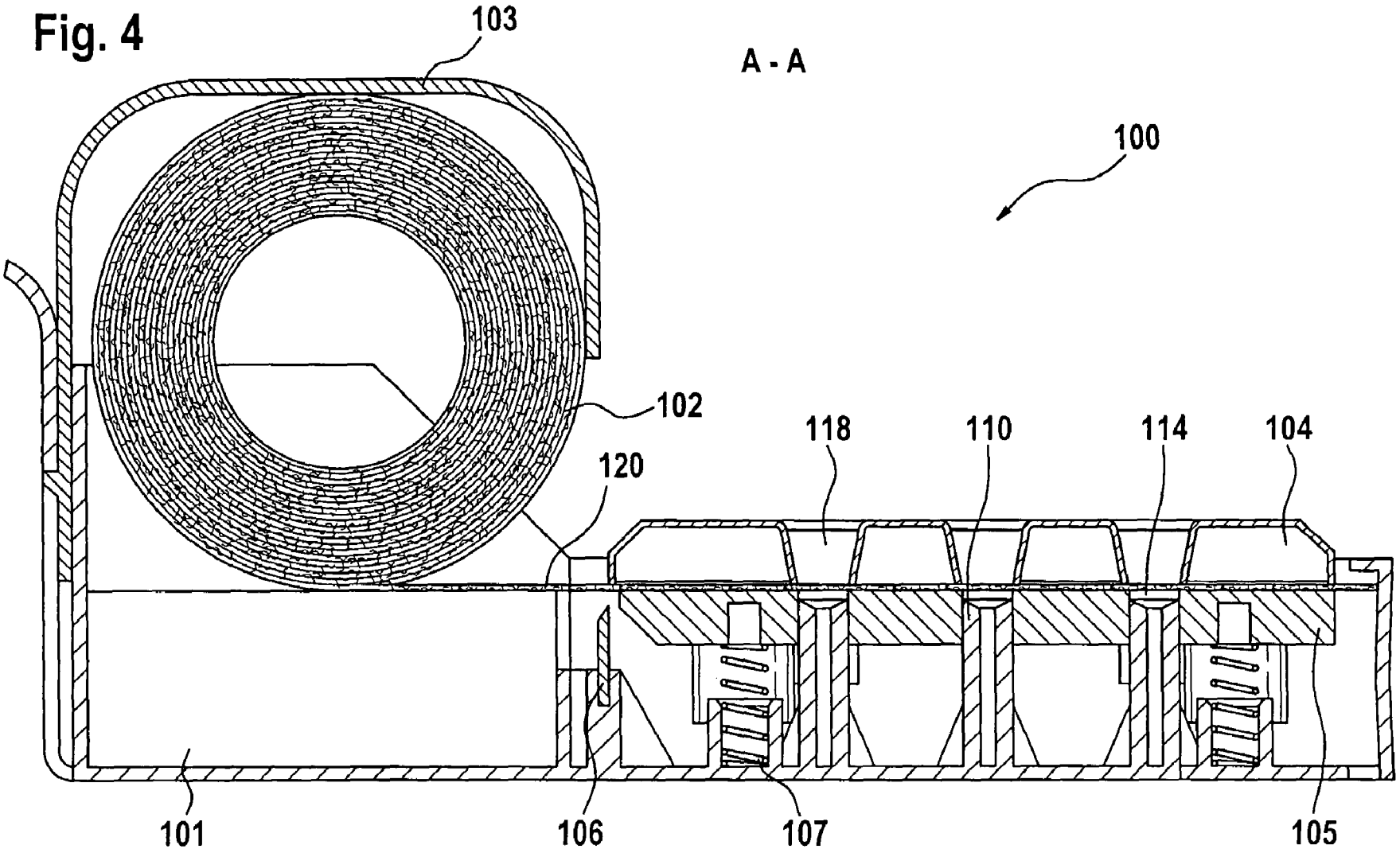
FIG. 4 is a cross section through the rolled product dispenser from FIG. 3, according to the arrows A-A.

FIG. 4 shows the section A-A from FIG. 3. The sectional view shows the sandpaper dispenser 100 in its starting position, containing a sandpaper roll 102. A segment 120 of the sandpaper roll 102 has been unwound from the roll and lies between the pressure plate 104 and the sandpaper receiving plate 105. The cutting blade 106 and the punching pins 110 are situated underneath the segment 120. The punching pins 110 are contained in the second bores 114 of the sandpaper receiving plate 105. The bores 118 of the pressure plate 104 are situated above the punching pins 110; viewed from the punching pins 110, these bores 118 are covered by the sandpaper segment 120.

Figure 5:
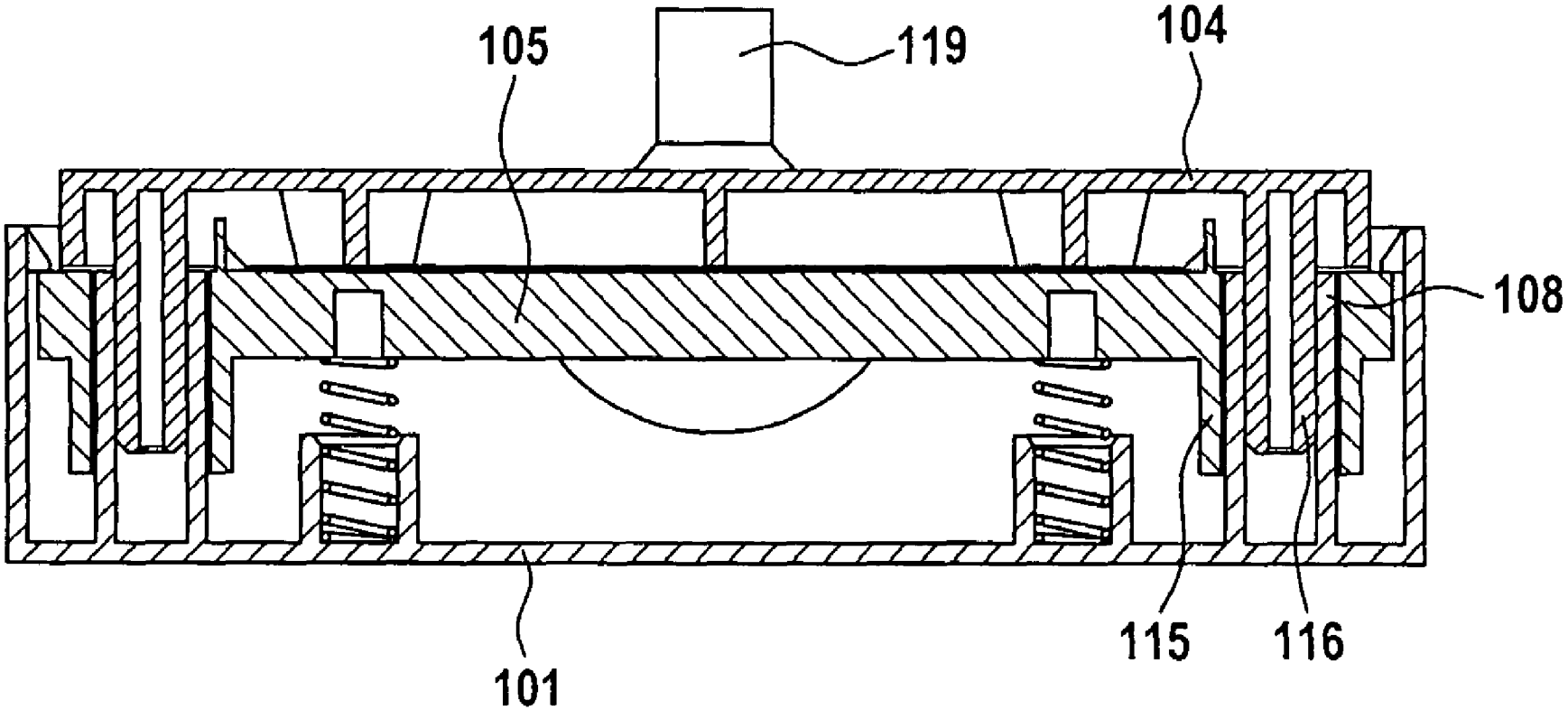
FIG. 5 is a cross section through the rolled product dispenser from FIG. 3, according to the arrows B-B.

FIG. 5 shows the section B-B from FIG. 3. This sectional view shows the guides of the pressure plate 104 and the sandpaper receiving plate 105. The guides 108 of the housing 101 guide both the pressure plate 104 and the sandpaper receiving plate 105. To that end, the pins 116 of the pressure plate 104 protrude into the guides 108 whereas the domes 115 of the sandpaper receiving plate 105 encompass the guides 108.

Figure 6:
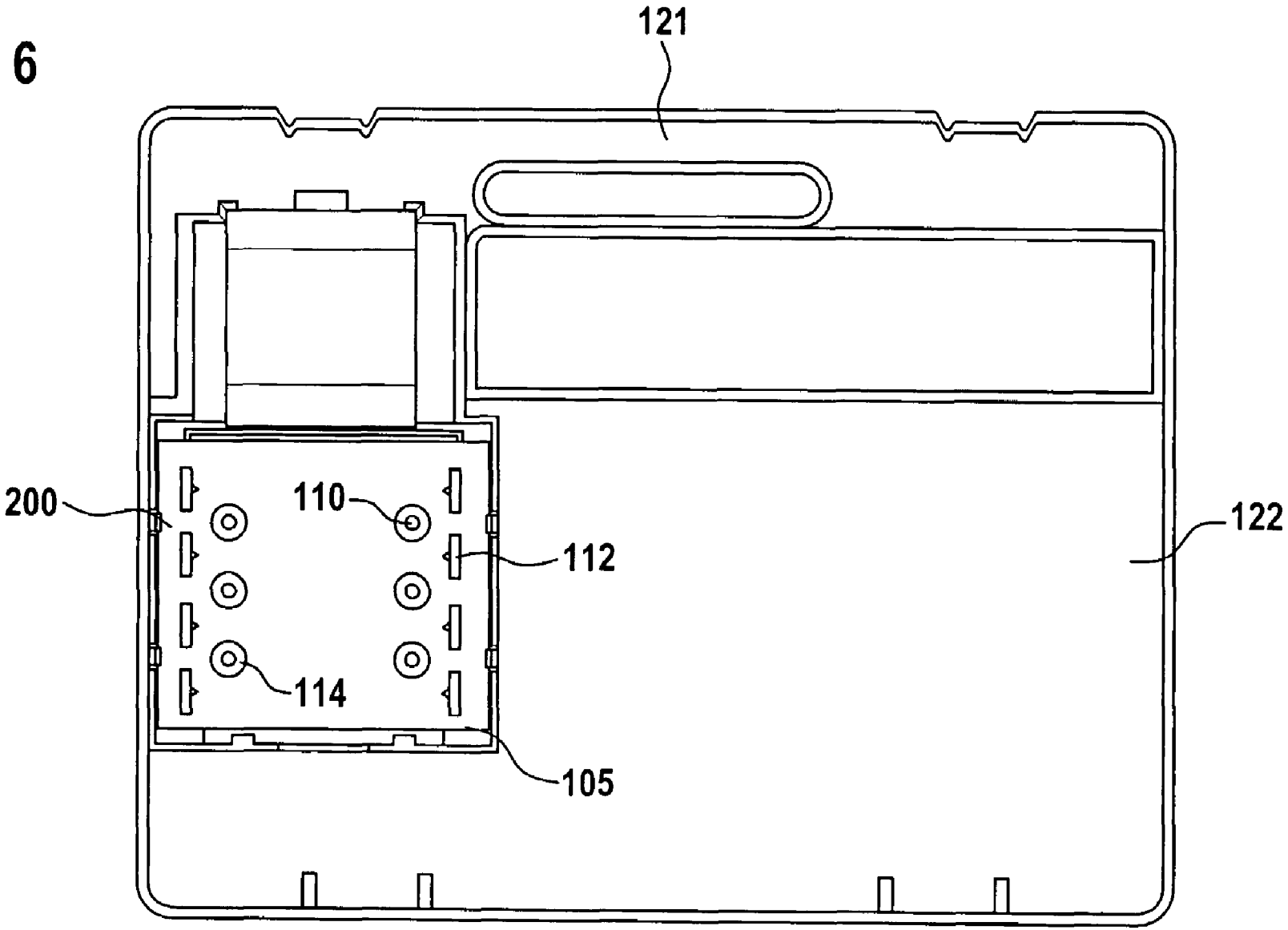
FIG. 6 shows a toolbox into which the rolled product dispenser according to the invention is integrated.

Finally, FIG. 6 shows an open sander box 121. The box 121 contains a sandpaper dispenser 200. The design of the sandpaper dispenser 200 corresponds to that of the sandpaper dispenser 100 except for the fact that the pressure plate 104 is attached to the box lid, not shown, of the box 121. The box bottom 122 contains the remaining elements of the sandpaper dispenser 200.

In conclusion, the operation of the sandpaper dispensers 100 and 200 will be explained below.

After the roll holder 103 is folded upward, a sandpaper roll 102 is inserted into the housing 101 provided, so that the grit of the sandpaper faces the bottom. Then the sandpaper is unrolled and slid over the sandpaper receiving plate 105 until it reaches the opposite housing wall. The unrolled sandpaper is pressed with a slight pressure against the lateral raised protrusions 113. Then the punching process for the suction holes and the cutting to the correct length can be executed simultaneously, either by pressing down on the separate pressure plate 104 (in the case of the sandpaper dispenser 100) or by closing the box lid with the pressure plate 104 attached to it (in the case of the sandpaper dispenser 200). In the combined punching and cutting process, the pressure plate 104 is lowered counter to the force of the compression springs 107 and carries the sandpaper segment 120 and the sandpaper receiving plate 105 along with it. The sandpaper segment 120 is pressed downward in a corresponding way so that both the stationery cutting blade 106 and the stationery punching pins 110 penetrate the sandpaper segment 120. As a result, the sandpaper segment 120 is perforated and simultaneously cut from the sandpaper roll 102. After the box 121 is opened and the pressure plate 104 is lifted, the ready-to-use sandpaper segment can be removed.

The above-described sandpaper dispensers 100 and 200 make it possible to cut a segment of sandpaper from a sandpaper roll to the correct length and to perforate it at the same time in a particularly simple, rapid fashion. Since the punching and cutting occur simultaneously in a single, simple work step, the sandpaper dispensers 100 and 200 are particularly convenient and effective to use. The cut, perforated sandpaper is ready for immediate use and can be mounted onto the sander the moment it is removed from the dispenser. In addition, the sandpaper is automatically cut to precisely the required length and is perforated at the correct locations.

What is claimed is:

1. A rolled product dispenser, comprising a roll holder for holding a roll of material, a hole punching device including plural stationary punching pins (110), a movable pressure plate (104), a movable receiving plate (105), and at least one compression spring (107); a stationary cutting edge (106), said pressure plate having cutting apertures for receiving said punching pins and having a linear cutting edge for receiving said stationary cutting edge; a housing (101) in which said compression spring (107), said plural punching pins (110), and said cutting blade (106) are accommodated, said housing (101) being provided with guides (108) for said receiving plate (105) and said pressure plate (104), said hole punching device being configured so that in a combined punching and cutting process said pressure plate (104) is lowered against a force of said compression spring (107), said pressure plate being quickly separable from said receiving plate and guides for insertion of said material.

2. The rolled product dispenser as recited in claim 1, wherein the rolled product dispenser (200) is integrated into a box (121).

3. The rolled product dispenser as recited in claim 1, wherein the rolled product dispenser (100, 200) is a sandpaper dispenser.

* * * * *